US006385841B1

(12) United States Patent
Weeks

(10) Patent No.: US 6,385,841 B1
(45) Date of Patent: May 14, 2002

(54) METHOD AND APPARATUS FOR INSTALLING STEAM BOILER TUBES

(75) Inventor: Bruce V. Weeks, Pataskala, OH (US)

(73) Assignee: Advanced Cutting Technologies, Ltd., Westerville, OH (US)

( * ) Notice: Subject to any disclaimer, the term of this patent is extended or adjusted under 35 U.S.C. 154(b) by 2 days.

(21) Appl. No.: 09/676,392

(22) Filed: Sep. 29, 2000

(51) Int. Cl.[7] ..... B23P 15/26
(52) U.S. Cl. ..... 29/727; 29/726; 29/890.051
(58) Field of Search ..... 29/727, 723, 33 T, 29/33 G, 726, 890.043, 890.051

(56) References Cited

U.S. PATENT DOCUMENTS 4,779,445 A * 10/1988 Rabe ..... 29/283.5
4,827,605 A * 5/1989 Krips et al. ..... 29/523
4,901,551 A * 2/1990 Widart ..... 29/523
5,129,246 A * 7/1992 Strickland et al. ..... 29/727
5,210,932 A * 5/1993 Tokura ..... 29/726
5,557,840 A * 9/1996 Terpening ..... 29/723
5,640,879 A * 6/1997 Damsohn et al. ..... 29/727
5,664,829 A * 9/1997 Thomson et al. ..... 297/195.1
5,806,173 A * 9/1998 Honma et al. ..... 29/726
5,815,901 A * 10/1998 Mason et al. ..... 29/33 D
5,916,321 A * 6/1999 Holmes et al. ..... 29/727
5,983,487 A * 11/1999 Snow et al. ..... 29/726
6,317,966 B1 * 11/2001 Insalaco et al. ..... 29/727

* cited by examiner

*Primary Examiner*—I Cuda-Rosenbaum
(74) *Attorney, Agent, or Firm*—Thomas S. Baker, Jr.

(57) ABSTRACT

A method and apparatus are disclosed which are for use in installing the end segments of boiler tubes in the drum walls of a high-pressure steam boiler, and which involve expanding rather than swaging boiler tube end segment metal into intimate contact with grooved boiler tube bores provided in the steam boiler drum walls.

7 Claims, 6 Drawing Sheets

20
20
24
14
10
2
2
12
12
12
12
16
18
18
24

METHOD AND APPARATUS FOR INSTALLING STEAM BOILER TUBES

CROSS-REFERENCES

None.

FIELD OF THE INVENTION

This invention relates generally to steam boilers, and particularly concerns both a method and apparatus that may be utilized advantageously to install original and replacement boiler tubes in the drums of steam boilers such as those steam boilers that are typically operated at very high steam pressures (e.g., to approximately 1,600 psi) and high temperatures (e.g., to approximately 1,250° F.) as in major electrical power generating plants in the United States.

BACKGROUND OF THE INVENTION

In the United States, and in connection with the construction and maintenance of steam boilers operated at very high steam pressures (e.g., to approximately 1,600 pounds per square inch) it is common practice to provide the ends of installed boiler tubes with flared end terminations that are formed by swaging and that function to secure tubes in place in the cooperating boiler drum wall bores during boiler operation. The boiler tubes have outside diameters that typically range from 1 inch to 6 inches, and wall thicknesses that typically range from as little as approximately 0.100 inch to as much as approximately 0.250 inch. The end segments of such tubes, after the tubes have been bent to their proper installed configuration, are slidably inserted into co-operating tube bores provided in the walls of the steam boiler drum components, and their end terminations are expanded or flared radially outward through use of a conventional rotary swaging machine. In the conventional practice no attempt is made to expand portions of the tube that lie within the limits of the drum wall thickness to thereby improve the initial fit or match of the boiler tube external diameter to the drum tube bore internal diameter, and thus enhance securing the boiler tube end segments to the boiler drum.

I have discovered a method of physically securing a boiler tube end segment to a co-operating boiler drum component that eliminates having to provide the end segment with a terminating end flare, and that simultaneously enhances the fit of the tube outside diameter to the drum wall boiler tube bore inside diameter.

Also, I have discovered a boiler tube expansion tool construction that is effective to develop in the installed boiler tube end segment both: (1) an installed tube shear resistance strength that is at least as great as that of a comparable installed boiler tube end segment having a flared end termination, and (2) an enhanced installed match between the tube exterior diameter and the interior diameter of the co-operating drum boiler tube bore.

Other objects and advantages of the present invention will become apparent during consideration of the drawings, descriptions, and claims which follow.

SUMMARY OF THE INVENTION

The method of the present invention involves the essential steps of: (1) providing at least one circumferential groove in the interior surface of a boiler tube bore in the steam boiler drum wall, (2) sliding the end segment of a properly sized boiler tube into the drum wall grooved boiler tube bore sufficiently that its end termination is positioned flush with the drum wall interior wall surface, (3) containing an incompressible fluid in the boiler tube end segment in a zone within the limits of the drum wall thickness, and (4) developing an extremely high pressure (e.g., 100,000 pounds per square inch) in the incompressible fluid contained in the tube end segment to thereby expand boiler tube end segment metal into contact with the drum wall boiler tube bore and its included internal circumferential groove(s). Afterwards the fluid pressure within the boiler tube end segment is reduced to an ambient pressure, and the tool is withdrawn from within the installed tube end segment. The process is repeated for each additional boiler end segment in the steam boiler installation.

The boiler tube hydraulic expansion tool of the present invention is basically an assembly comprised of an actuator section, a co-operating fluid pressure multiplier section, and a conventional source of pressurized primary incompressible fluid for operating the apparatus actuator section. The fluid pressure multiplier section has a nose extension that carries suitably spaced-apart and longitudinally-restrained elastomeric fluid seal and metal seal back-up combinations, and that, when properly inserted into the boiler tube end segment which is to be expanded, completes the creation of a secondary fluid containment chamber. The so-created secondary fluid containment chamber receives, through the fluid pressure multiplier section nose extension, a preferred secondary incompressible fluid at a pressure that is a multiple of the pressure of the pressurized primary incompressible fluid. The primary and secondary incompressible fluids that are preferred for use in the invention tool assembly are conventional petroleum-based hydraulic fluid and water, respectively; the extent of pressure multiplication that is provided in the invention boiler tube segment expansion tool is generally in the range of increasing a 2,000 psi primary fluid operating pressure to a 100,000 psi secondary incompressible fluid metal expansion pressure.

DETAILED DESCRIPTION

Figure 1:
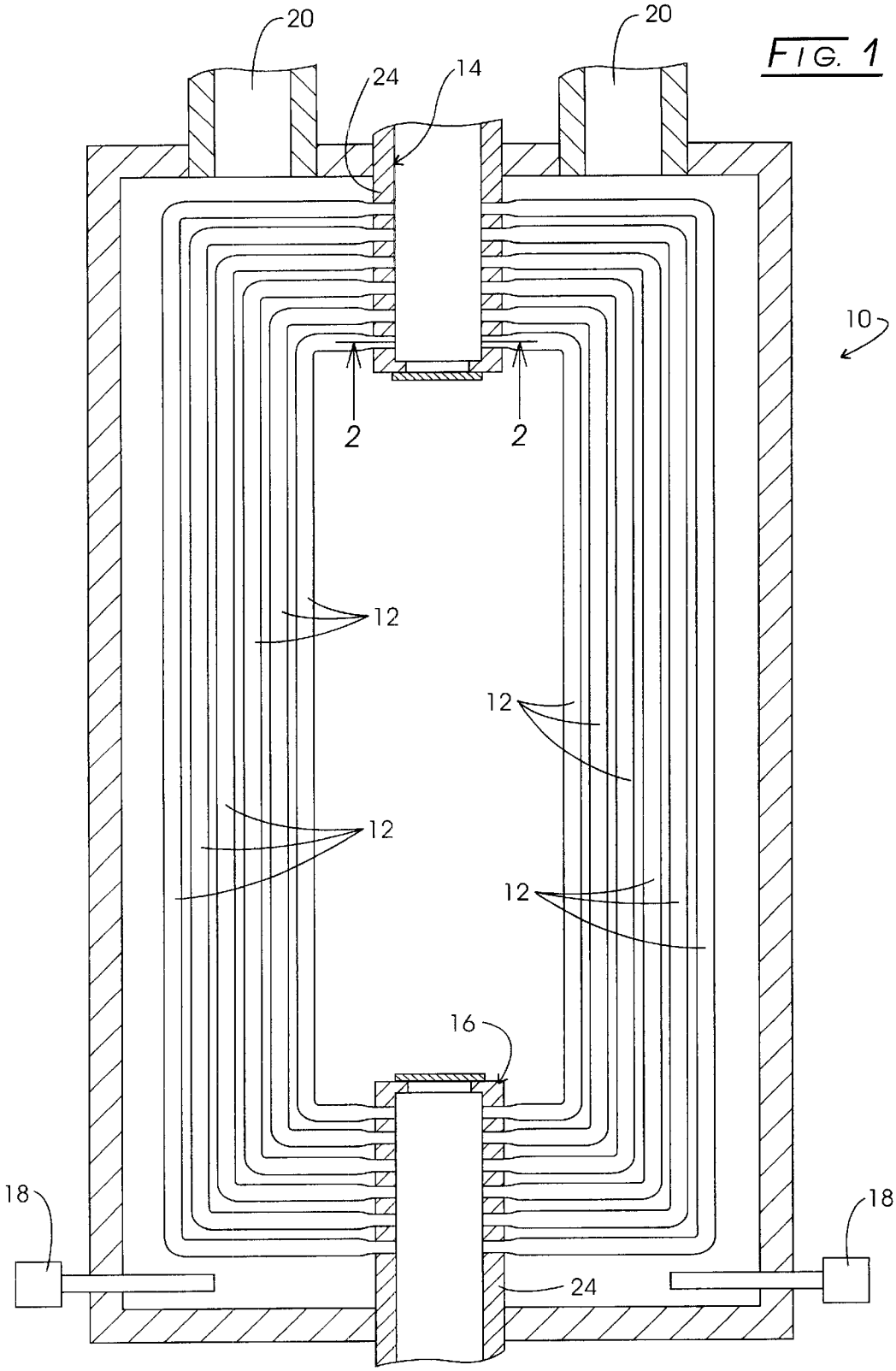
FIG. 1 is a schematic vertical section of a water-tube power boiler illustrating the environment in which the method and tool of the present invention are typically utilized.
Figure 2:
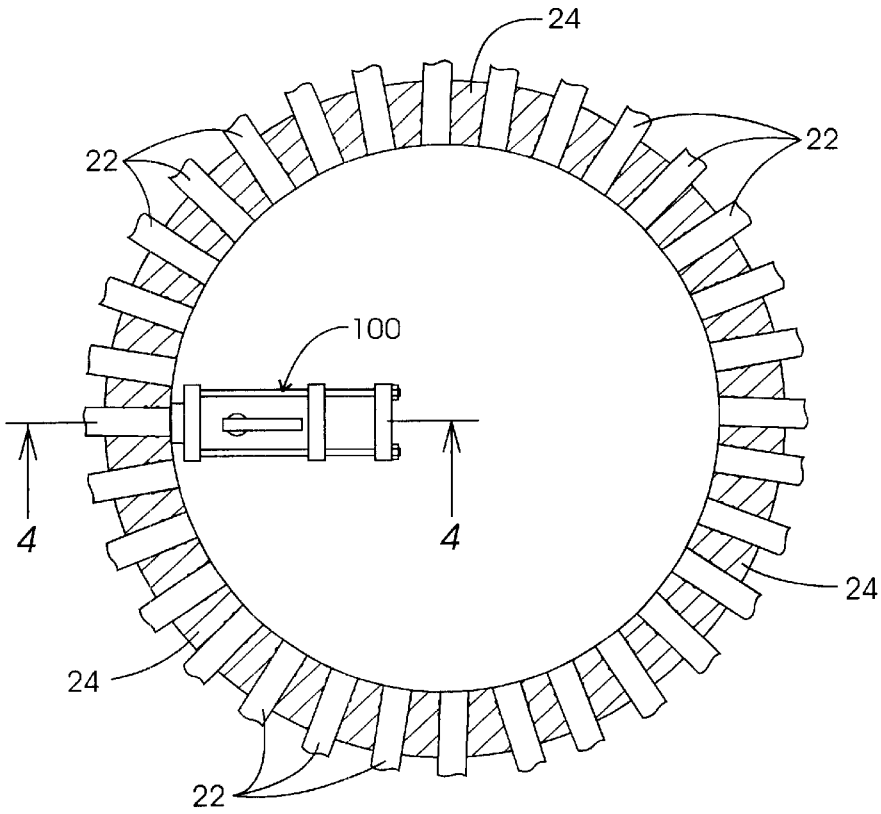
FIG. 2 is a section view taken at line 2—2 of FIG. 1.
Figure 4:
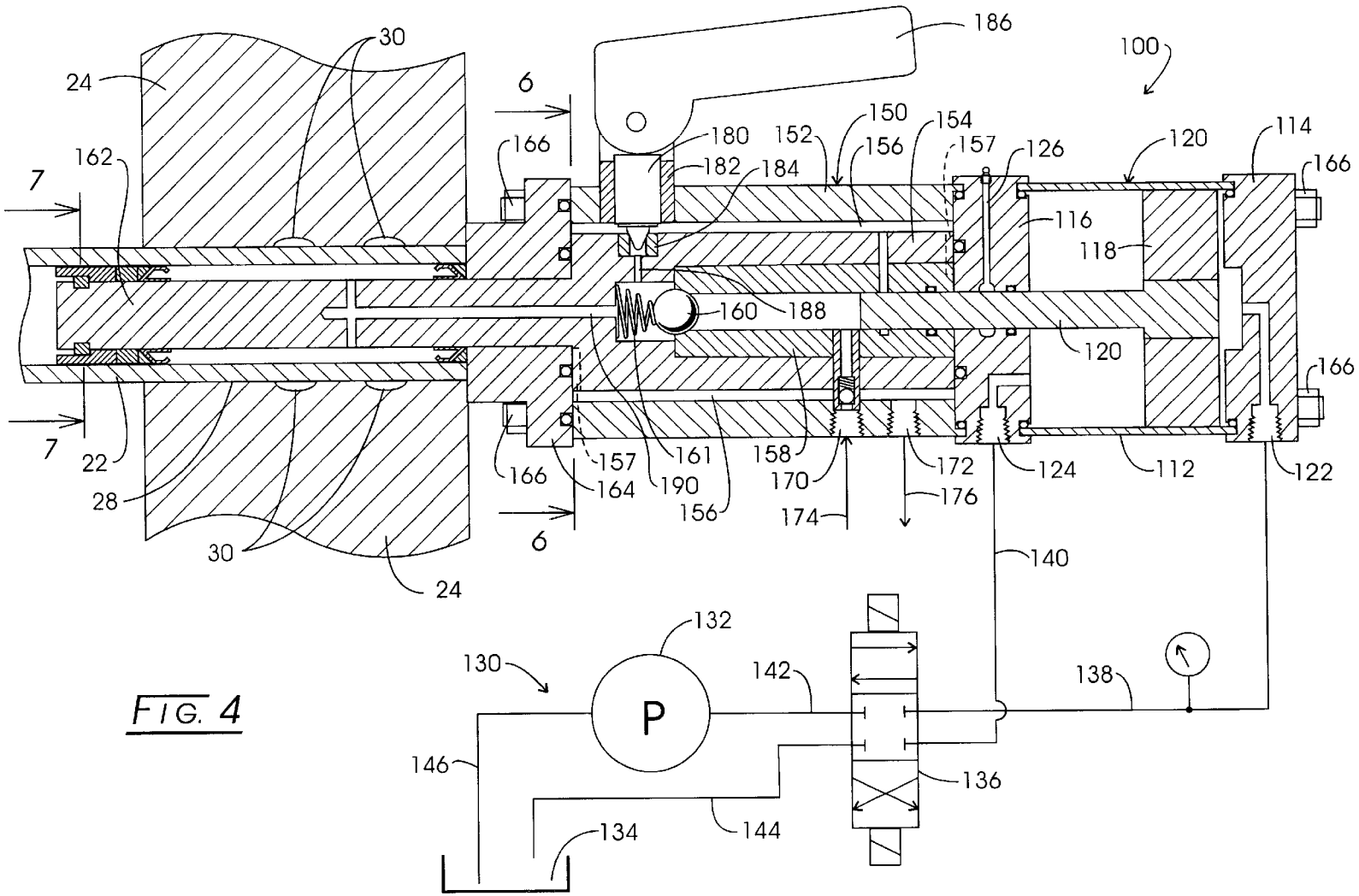
FIG. 4 is a sectional view taken at line 4—4 of FIG. 2 and illustrating the boiler tube expansion tool of FIG. 3 in a first operating condition.
Figure 5:
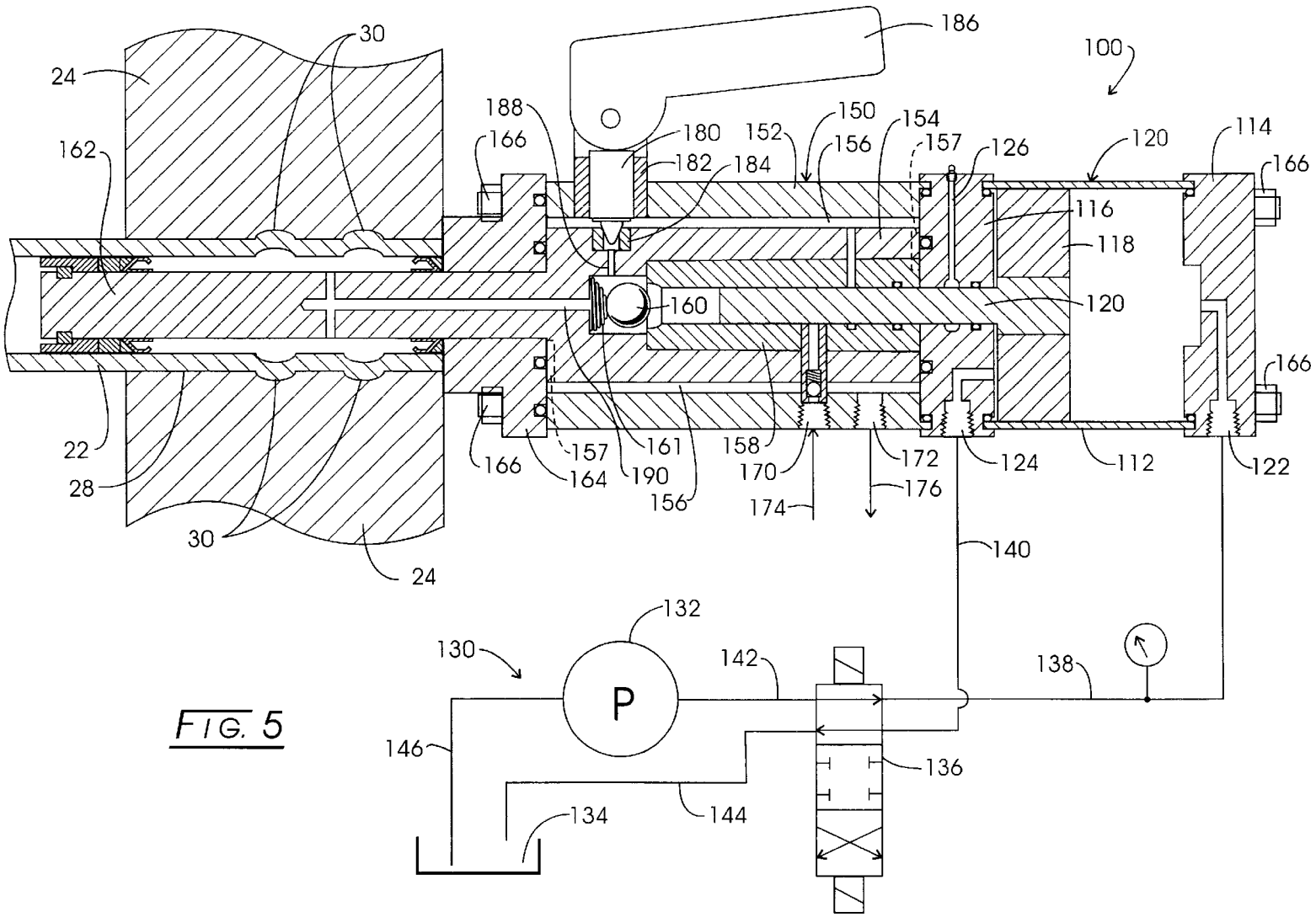
FIG. 5 is a sectional view, similar to FIG. 4, but illustrating the invention boiler tube expansion tool in a second operating condition.

FIG. 1 schematically illustrates a steam boiler 10 having multiple conventional boiler water-tubes 12 installed with their upper and lower flared ends co-operating with the walls of the boiler steam and mud drums 14 and 16, respectively. Burners 18 are typically fired by a carbonaceous fuel, and the resulting effluent gasses of combustion, following heat extraction for water and steam heating purposes, are exhausted from within power boiler 10 through chimney connections 20. Boiler tubes 12 of a proper size and exterior configuration have their end segments 22 (see FIG. 2) co-operatively installed in the walls 24 of the boiler steam and mud drums 14 and 16. The boiler tube expansion tool 100 of the present invention is utilized to properly secure the end segments of each boiler tube in their respective boiler tube bores 28 of drum peripheral walls 24, as illustrated in FIG. 2, such tool is basically utilized from within the applicable boiler drum. Each boiler tube bore 28 is provided with at least one machined circumferential expansion groove 30, as illustrated in FIGS. 4 and 5, into which portions of the tube end segment is expanded by use of tool assembly 100 as shown in FIG. 5.

Figure 3:
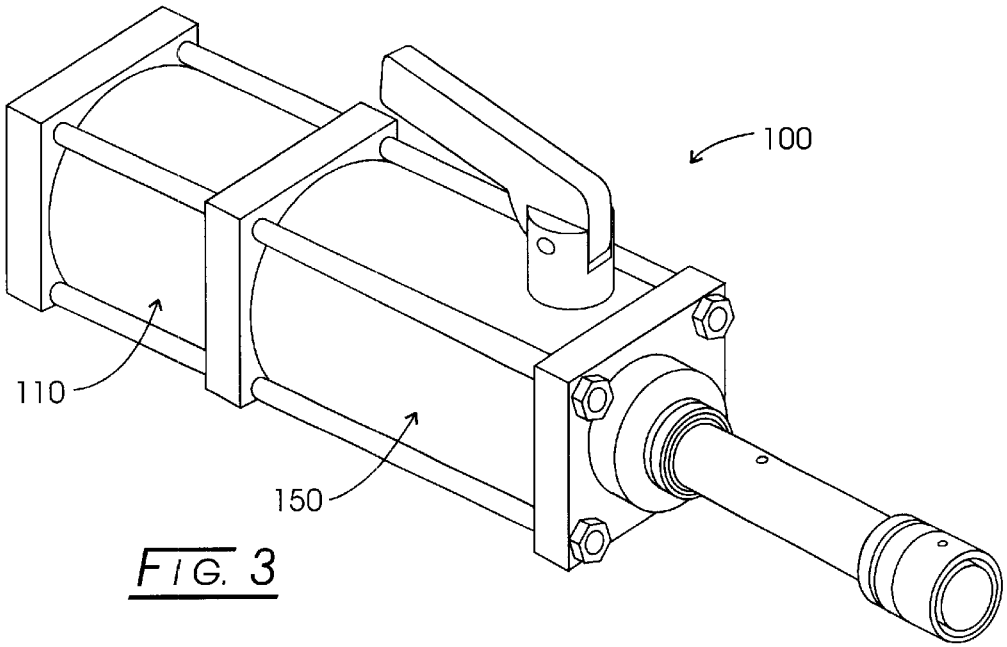
FIG. 3 is a perspective view of a preferred embodiment of the boiler tube expansion tool of the present invention.

FIG. 3 illustrates the tube expansion tool assembly 100 as basically consisting of a fluid actuator subassembly 110 and a co-operating pressure multiplier subassembly 150. Also considered to be a part of the assembly, but not illustrated in FIG. 3, is a conventional hydraulic power system 130 (see FIGS. 4 and 5) that flows a pressurized primary incompressible fluid to and from fluid actuator subassembly 110 during actuator section operation.

Tool hydraulic actuator subassembly 110 is basically comprised of an actuator cylinder 112, cylinder end plates (end closures) 114 and 116, an actuator internal piston 118, and an actuator piston rod 120 preferably threadably joined to piston 118. A typical length of stroke for actuator piston element 118 is approximately 3 inches. Piston rod 120 co-operates with and projects through end plate 116 and functions as a piston within tool pressure multiplier subassembly 150. In order to achieve the desired degree of pressure multiplication during operation of tool assembly 100 for boiler tube end segment expansion purposes, the design ratio of the cross-sectional area of piston element 118 to the cross-sectional area of piston rod element 120 is preferably approximately 50. Also included in tool hydraulic actuator subassembly 110 are actuator fluid inlet passageway 122 and actuator fluid outlet passageway 124. Thus, primary incompressible fluid introduced into tool hydraulic actuator subassembly 110 through inlet 122 and at a pressure of 2,000 psi will result in a secondary incompressible fluid pressure of approximately 100,000 psi in the fluid containment passageways of tool subassembly 150. A lubrication passageway 126 with a conventional grease fitting is included in end plate member 116 of actuator section 110.

Conventional hydraulic power system 130 is basically comprised of a hydraulic pump 132, a hydraulic fluid reservoir 134, a typical 4-way hydraulic valve 136, and connecting fluid lines 138 through 144. Fluid lines 138 and 140 connect actuator section inlet and outlet passageways 122 and 124, respectively, to 4-way valve 136. Fluid line 142 connects pump 132 to 4-way valve 136, fluid line 144 connects 4-way valve 136 to reservoir 134, and fluid line 146 flows primary incompressible fluid from reservoir 134 to hydraulic pump 132. Hydraulic fluid actuator section 110 of tool assembly 100 normally receives pressurized primary incompressible fluid from conventional hydraulic system 130 preferably at approximately a 2,000 psi operating pressure. Also, and as previously indicated, the primary incompressible fluid preferred for utilization in hydraulic system 130 and co-operating hydraulic actuator subassembly 110 is a petroleum-based conventional hydraulic fluid. (Water is the preferred secondary incompressible fluid utilized in connection with practice of the present invention).

Figure 6:
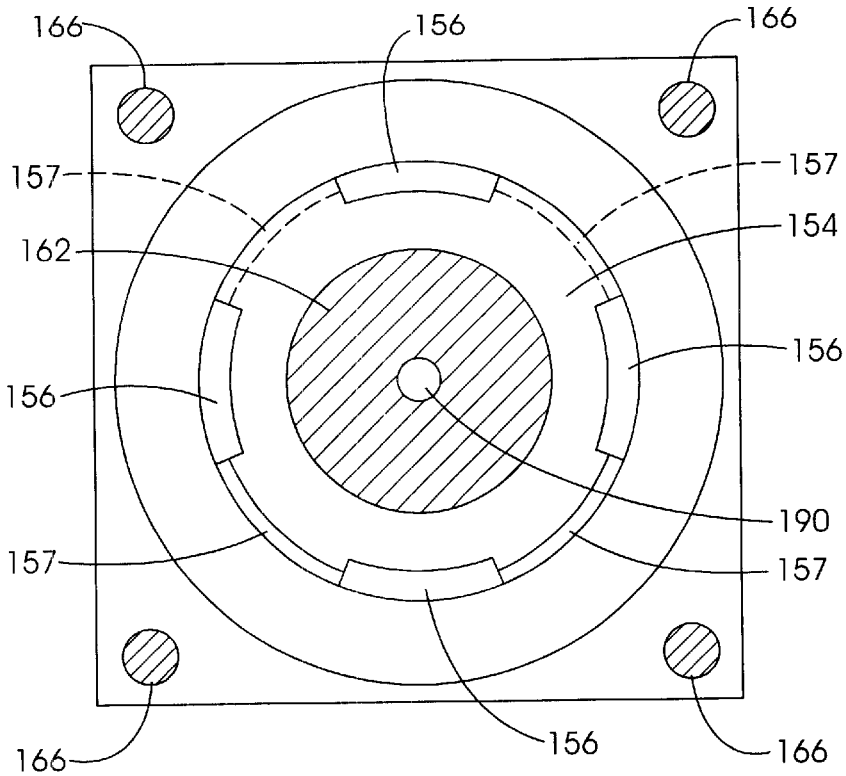
FIG. 6 is a section view taken at line 6—6 of FIG. 4.
Figure 7:
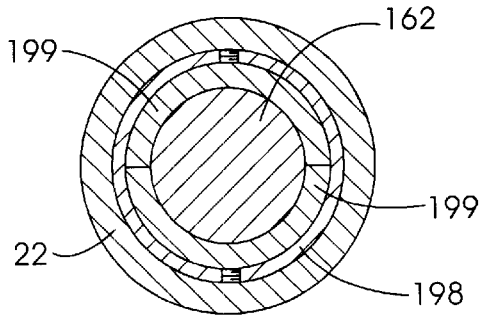
FIG. 7 is a section view taken at line 7—7 of FIG. 4.

Referring also to FIGS. 4 and 5, tool assembly 100 has a pressure multiplier subassembly 150 that is basically comprised of an outer tubular cylinder 152, a tool core element 154 that has a body base section whose exterior surface slidably engages the interior surface of tubular cylinder 152 and is provided with longitudinal undercuts 156 and circumferential end undercuts 157 (see FIG. 6) that comprise a blow-by fluid labyrinth passageway communicating with fluid outlet 124, a tubular check valve body 158 that slidably receives the reduced diameter end of actuator piston rod 120, and a check valve ball 160 which is biased into its normally closed position by centering spring 161. Tool core element 154 also is provided with a cylindrical body extension section 162 that is integral with the tool core body section and projects beyond a stop end plate 164 of assembly 100, that has an integral retainer groove 193 located near its free end, and that functions to carry the hereinafter-described pressure seals that engage the inner cylindrical surface of boiler tube end segment 22. Bolt-like threaded tie rods 166 cooperate with end plates 114, 116, and 164 in a conventional manner to maintain sections 110 and 150 of expansion tool assembly 100 in their properly assembled state.

The joined hollowed interior portions of tubular check valve body 158 and tool core 154, together with internal passageway 190 and the sealed annular expansion chamber formed intermediate core extension 162 and boiler tube end segment 22, comprise a secondary incompressible fluid containment chamber.

Further comprising pressure multiplier section 150 of assembly 100 are fluid inlet 170, fluid outlet 172, secondary fluid supply line 174, and secondary fluid return line 176. Lines 174 and 176 preferably are conventional water supply and drain lines. Also included in pressure multiplier subassembly 150 is a secondary fluid vent comprised of vent valve poppet 180, tube-like vent valve sleeve 182 that is carried by outer cylinder 152 and slidably receives vent valve poppet 180, annular vent valve poppet seat 184, and a rotatable vent valve actuating handle 186 that is pivotally carried by vent valve sleeve 182, that engages the free end of vent valve poppet 180, and that is manually operated to open and close internal passageway 188 relative to labyrinth passageway 156. Basically, the vent valve is first manually operated to an open or venting condition when secondary incompressible fluid is being admitted to pressure multiplier subassembly 150, maintained in a closed condition when pressurized primary incompressible fluid is being ported to actuator fluid inlet 122, and again manually operated to an open or venting condition to relieve the elevated fluid pressure that exists in pressure multiplier subassembly 150 after the expansion of boiler tube end segment 22 has been completed.

Figure 8:
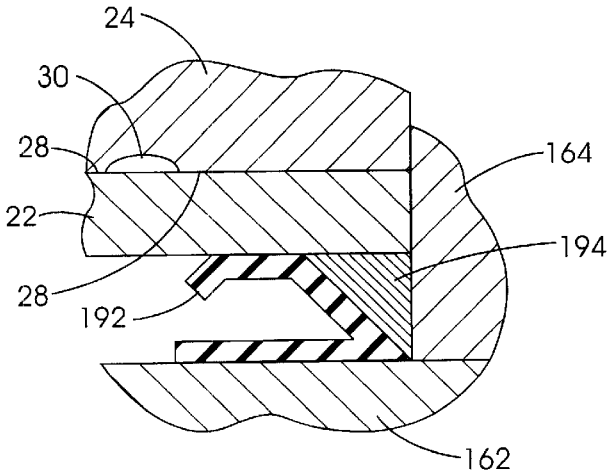
FIGS. 8 and 9 are enlarged views of portions of the views of FIGS. 4 and 5.
Figure 9:
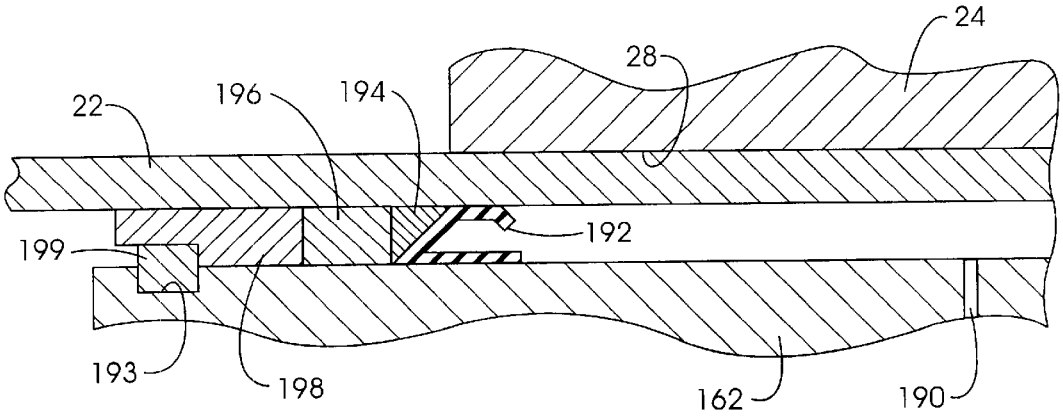

Further included in assembly 100 is check valve outlet passageway 190 through which secondary incompressible fluid is ported to the annular space defined in part by the internal wall surface of boiler tube end segment 22 and the outer cylindrical surface of tool core body extension 162. Referring to FIGS. 8 and 9, assembly 100 also includes elastomeric pressure seals 192, each carried by the cylindrical surface of tool core body extension 162 and each having a generally U-shaped cross-section configuration, circumferentially split back-up rings 194 which are also carried by the cylindrical surface of tool core body extension 162, which function to prevent the unwanted extrusion of each elastomeric seal 192 under conditions of extremely high secondary incompressible fluid pressure during boiler tube end segment expansion, and which are preferably made of a bronze alloy and with a circumferential diagonal cut, and one (or more) spacer ring(s) 196. Also included are end sleeve 198, and diametrically split retainer ring 199. Split retainer ring 199 co-operates with the circumferential retainer groove 193 provided near the free end of tool core nose extension 162. Retainer ring 199, end sleeve 198, and spacer ring(s) 196, in combination with stop end plate 164, define the longitudinal limits of the annular expansion chamber located between boiler tube end segment 22 and the outer surface of tool core body extension 162 to which highly-pressurized secondary incompressible fluid is admitted during the boiler tube end segment expansion. The length of such annular expansion chamber must not exceed, and preferably is slightly less than, the thickness of boiler drum wall 24.

From a method standpoint, it is necessary to have at least one appropriate circumferential expansion groove 30 provided in each drum wall boiler tube bore 28 prior to insertion of a boiler tube end segment 22 into that bore. Such expansion groove(s) may be provided at the time of original manufacture of the incorporating steam boiler drum wall, or may be provided by appropriate machining at the time of boiler tube replacement as in connection with boiler maintenance operations. Basically, the total width of the provided circumferential expansion groove(s) 30 must result in a total shear zone in expanded tube metal that is adequate (with an included safety factor) to fully resist the maximum longitudinal loads and shear stresses imposed on boiler tube end segment 22 during high-pressure, high-temperature steam boiler operation.

Next, boiler tube end segment 22 is slidably inserted into grooved boiler tube bore 28 a sufficient distance until the free end of that boiler tube end segment is positioned flush with the wall surface of drum wall 24. The boiler tube end segment is then ready for insertion of and co-operation with tool assembly 100.

Core body nose extension 162 of boiler tube expansion tool assembly 100, with properly positioned seals 192 and split bronze back-up rings 194, is inserted into boiler tube end segment 22 until stop end plate 164 abuts the wall surface of drum wall 24 and the free end of boiler tube end segment 22. With poppet valve 180 in an open condition, ordinary tap water at a typical tap pressure of approximately 30 psi is next flowed into inlet opening 170 and through check valve 160 and passage 190 of tool pressure multiplier section 150 until that section of the tool is properly filled and excess secondary incompressible fluid (water) flows through labyrinth passageway 156, 157 and out of fluid outlet 172. The handle 186 of the vent valve is then manually actuated to move poppet valve 180 to its closed condition when firmly seated on vent valve poppet seat 184.

I then operate hydraulic power system 130 at a pump outlet pressure of approximately 2,000 pounds per square inch (psi) to move actuator piston 118 from its FIG. 4 position to its position shown in FIG. 5. In the process of accomplishing that step, and because of the preferred ratio of cross-section areas of piston element 118 to piston rod element 120, the pressure of the secondary incompressible fluid (water) flowed into tool pressure multiplier section 150 is increased to approximately 100,000 psi thereby causing the metal of tube end segment 22 to come into intimate contact with all interior surfaces of boiler tube bore 28 including the surfaces of the undercut groove(s) 30 previously provided in the bore. Because of the extremely high metal expansion pressure, secondary incompressible fluid blow-off may be experienced and will be evidenced by a low-pressure flow of that incompressible fluid out of tool pressure multiplier section 150 through labyrinth passageway 156, 157 and fluid outlet 176.

After the system maximum pressures have been attained, and the expansion of boiler tube end segment metal completed, hydraulic system 4-way valve 136 is operated to return actuator piston 118 to its original FIG. 4 position and hydraulic system 130 is then shut down. Vent poppet valve 180 is afterwards opened and expansion tool assembly 100 is withdrawn from engagement with boiler tube end segment 122. Typically, the flow of boiler tube end segment metal radially outward as a result of the herein described method and apparatus operation is in the range of 0.020 to 0.040 inches, and the length of the metal expansion zone is generally in the range of from approximately 2 to approximately 6½ inches.

Also, and because of the extremely high operating pressures that are involved, I prefer that especially piston element 118, piston rod element 120, core member 154, and check valve body 158 be made of a hardened tool steel. Other metal components are generally and preferably made of a conventional stainless steel alloy. Also, illustrated in the accompanying drawings, but not specifically referenced and described in this detailed description, are numerous conventional O-ring type elastomeric seals serving their typical pressure-sealing function.

Various changes may be made to the disclosed shapes, sizes, and materials of construction for the apparatus of this invention without departing from the scope, meaning, or intent of the claims which follow.

I claim as my invention:

1. An expansion tool assembly for co-operation with a boiler tube end segment during the installation of that boiler tube end segment in a steam boiler drum wall grooved boiler tube end segment bore, and comprising:

an actuator subassembly actuated by pressurized primary incompressible fluid, and having an actuator subassembly cylinder, an actuator subassembly piston positioned within said actuator subassembly cylinder, and an actuator subassembly piston rod connected to said actuator subassembly piston and projecting beyond said actuator subassembly cylinder;

a pressure multiplier subassembly joined to and actuated by said actuator subassembly, and having a seal-carrying tool core element that engages the interior of the boiler tube end segment in sealed relation, that with the boiler tube end segment forms a secondary incompressible fluid containment chamber, and that contains a secondary incompressible fluid filling said secondary incompressible fluid containment chamber; and a power supply subassembly providing pressurized primary incompressible fluid to said actuator subassembly to move said actuator subassembly piston and further project said actuator subassembly piston rod beyond said actuator subassembly cylinder and into said pressure multiplier subassembly secondary incompressible fluid containment chamber, said actuator subassembly piston rod when further projected beyond said actuator subassembly cylinder by pressurized primary incompressible fluid increasing the pressure of said secondary incompressible fluid by a multiple that is the ratio of the cross-sectional area of said actuator subassembly piston to the cross-sectional area of said actuator subassembly piston rod to thereby force boiler tube end segment metal radially outward and into intimate contact with the surface of the steam boiler drum wall grooved boiler tube end segment bore.

2. The expansion tool assembly invention defined by claim 1 wherein said ratio of the cross-sectional area of said actuator subassembly piston to the cross-sectional area of said actuator subassembly piston rod is approximately 50.

3. The expansion tool assembly invention defined by claim 1 wherein said primary incompressible fluid is conventional hydraulic fluid and said secondary incompressible fluid is water.

4. The expansion tool assembly invention defined by claim 1 wherein said pressure multiplier subassembly further comprises a blow-by fluid labyrinth passageway, said blow-by fluid labyrinth passageway functioning to reduce the flow velocity of secondary incompressible fluid leaking at elevated pressures from said pressure multiplier subassembly to the tool assembly ambient environment.

5. The expansion tool invention defined by claim 1 wherein said pressure multiplier subassembly tool core element further comprises a tool core body base section and a cylindrical tool core body extension section integrally joined to said tool core body base section, said tool core body extension having a cross-section diameter that is less than the internal diameter of the boiler tube end segment, having a length greater that the thickness of the steam boiler drum wall containing the grooved boiler tube end segment bore, and having an internal fluid passageway that ports secondary incompressible fluid from within said tool core body base section to an annular fluid containment chamber defined in part by the interior surface of the boiler tube end segment and by the cylindrical surface of said tool core body extension section.

6. The expansion tool invention defined by claim 5 wherein said tool core body extension section supports a pair of spaced-apart elastomeric ring seals that each have a U-shape cross-section configuration, supports a pair of metal back-up rings respectively contacting said pair of spaced apart elastomeric ring seals, and is provided with a retainer ring that restricts lateral movement of one ring of said pair of metal back-up rings in a direction away from said tool core body base section, said spaced-apart elastomeric ring seals also in-part defining said annular fluid containment chamber partly defined by the interior surface of the boiler tube end segment and by the cylindrical surface of said tool core body extension section.

7. The expansion tool invention defined by claim 6 wherein said pair of metal back-up rings each have a diagonal cut allowing expansion of the ring during pressurization of said secondary incompressible fluid in said annular fluid containment chamber.

* * * * *